United States Patent [19]

Goessler et al.

[11] Patent Number: 5,055,819

[45] Date of Patent: Oct. 8, 1991

[54] TEMPERATURE SWITCH

[75] Inventors: Gerhard Goessler, Oberderdingen; Eugen Wilde, Knittlingen, both of Fed. Rep. of Germany

[73] Assignee: E.G.O. Elektro-Gerate Blanc u. Fischer, Fed. Rep. of Germany

[21] Appl. No.: 626,237

[22] Filed: Dec. 12, 1990

Related U.S. Application Data

[63] Continuation of Ser. No. 365,376, Jun. 13, 1989, abandoned.

[30] Foreign Application Priority Data

Jun. 25, 1988 [DE] Fed. Rep. of Germany ..... 3821495
Jun. 25, 1988 [DE] Fed. Rep. of Germany ..... 3821496

[51] Int. Cl.[5] ..... H01H 37/48; H05B 3/72

[52] U.S. Cl. ..... 337/394; 219/449; 337/382

[58] Field of Search ..... 219/448, 449, 464, 512; 337/382, 393, 394, 395

[56] References Cited

U.S. PATENT DOCUMENTS 4,631,390 12/1986 Crossley et al. ..... 219/449
4,665,307 5/1987 McWilliams ..... 219/449
4,700,051 10/1987 Goessler et al. ..... 219/464

*Primary Examiner*—Harold Broome
*Attorney, Agent, or Firm*—Eckert Seamans Cherin & Mellott

[57] ABSTRACT

A temperature switch, used more particular as a temperature limiter for a radiation heating element (11) for heating a glass-ceramic plate (12), has radiation heaters (13, 14). Its rod-shaped temperature sensor (20) has an expansion rod (24) which is disposed in a tube (25) acting as a comparison norm and can be made of a chromium-iron-aluminum alloy and is heat-treated above 1100° C. The tube (25) can be made of a radiation-absorbing material or is coated with such a material, for example, cordierite, non-transmissive glass-ceramics or quartz material. The result of both steps is that the temperature switch has an enhanced switching amplitude and therefore a reduced switching frequency.

15 Claims, 1 Drawing Sheet

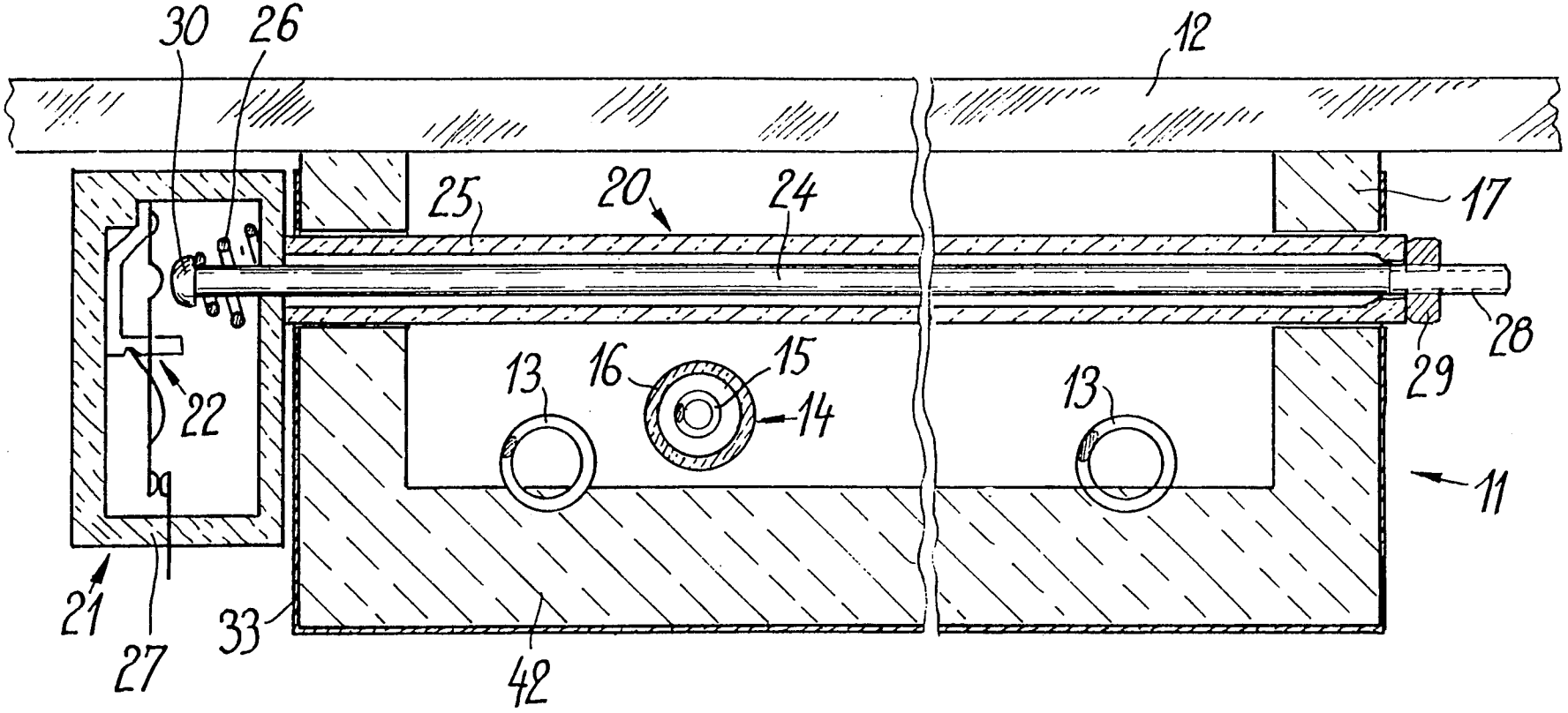
11
12
13
13
14
15
16
17
20
21
22
24
25
26
27
28
29
30
33
42

TEMPERATURE SWITCH

This is a continuation of application Ser. No. 365,376, filed June 13, 1989, now abandoned.

BACKGROUND OF THE INVENTION

1. Field of the Invention

The invention relates to a temperature switch to be subjected to radiation heating from a radiation source and having at least one switch contact and a temperature sensor.

2. Prior Art

European Patent 116 861 discloses a temperature switch of the kind specified wherein a web made of the insulating material of the radiant heating element in which the switch is incorporated provides a radiation screen and therefore a temporary delay of response. This means that during starting phases of heating or boiling the radiant heating member can be brought to a higher temperature level, which during further operation is reduced to a permanent state which reliably prevents damage to the glass-ceramics plate during continuous operation.

Also as a result, the switching amplitude and hysteresis are increased, so that the switching frequency can be reduced to a permissible value in all conditions.

European Patent B 150 087 discloses a temperature switch for the heating of a glass-ceramics plate, wherein a quartz glass tube is used which selectively absorbs only radiation with a wave length which is radiated back from the glass-ceramics plate, to allow the temperature switch to respond to the temperature of the glass-ceramics plate. The radiation arriving from the radiation source is to be let through, but a temporary delay of response cannot be achieved.

For the same purpose and on the basis of the same principle, according to WO 85/01412 the expansion rod or the tube enclosing the rod is given a radiation-reflecting coating. The reflecting coating calls for additional steps in manufacture, and moreover its operation is endangered in operation, since the reflectivity may decline.

SUMMARY OF THE INVENTION

It is an object of the invention to provide a temperature switch which obviates the disadavantages of the prior art and is particularly simply and effectively constructed.

Object is achieved by a temperature switch to be subjected to radiation heating from a radiation source and having at least one switch contact and a temperature sensor. The switch has an expansion rod made of a material having a relatively higher coefficient of thermal expansion, and a tube which encloses the expansion rod and is made of a material having a relatively lower coefficient of thermal expansion. Means are provided for temporarily delaying response of the temperature switch to heating, more particularly to radiation, the tube having at least partially a radiation absorbing material which mainly absorbs the radiation arriving from the radiation source.

If preferably the tube has at least partially a radiation-absorbing material, or is made of such material, the radiation-absorbing material primarily absorbs the radiation of the radiant heating element. Initially, therefore, the radiation does not reach the expansion rod. However, the tube becomes heated and gives off heat, even though with delay, by its own radiation and convection to the expansion rod. Since the material of the tube has a lower, but not completely negligible coefficient of expansion in comparison with the expansion rod, the increased initial heating of the tube in comparison with the expansion rod also produces a certain counter-compensation, something which further boosts the delaying effect. During further operation, the very low switching amplitude due to the highly response-sensitive basic characteristic of the switch is increased as desired, so that the switching frequency is reduced.

The delaying characteristic can be given the required value by the tube having wholly or partially radiation-absorbing material. This might, for example, take the form of a coating. Preferably, however, the tube itself is made of a radiation-absorbing material.

The delaying effect is further improved if the tube has increased thermal inertia. This means that it has an increased mass and/or specific heat, so that the radiant heat is stored before being passed on to the expansion rod. After the heating element has been switched off, this heat still acts on the expansion rod and delays its cooling. Even a low thermal conductivity of the tube material contributes towards this end.

Preferably the tube is made of a sintered ceramic material, for example, cordierite, which has outstanding properties of radiation absorption accompanied by low values of reflection.

However, the tube can also be advantageously produced from a glass-ceramic, more particularly with low transmission properties. Low transmission properties can be produced by a metal oxide admixture. Radiation-absorbing, non-transmissive quartz material has also proved suitable for manufacture.

If in a preferred embodiment the expansion rod is at least partially made of a chromium-iron aluminum alloy which is heat-treated at a temperature above 800° C. (about 1100 K), preferably above 1100° C (about 1400 K), astonishingly enough in comparison with the conventional chromium-nickel material hitherto used for the expansion rod, the switching amplitude is substantially increased from, for example, ±2 K to ±5.5 K. The chromium-iron-aluminum alloy, preferably containing about 22% chromium and about 5% aluminum can be obtained under the name "Kanthal A, A1, AF" from Kanthal AB, Sweden, and has hitherto been used as an electric resistance material. In conjunction with the heat treatment it achieves the stated values of thermal delay and increase in switching amplitude.

Particularly advantageously, the temperature switch can be used in a radiation heating element having at least one high temperature radiant heating element, for example, a heating resistor enclosed by a lamp holder. Otherwise, due to its rapid response the switching amplitude might become very low and therefore result in an increased switching frequency which would be impermissible, more particularly also due to the high starting currents of such high temperature radiation heating elements. The temporary effect of delay in response may be of such a value that it permits a brief initial overheating of the glass-ceramics plate which due to its brevity causes no damage, but it can also be of lower value, so that due to the higher mass of the glass-ceramics plate, it compensates any delay which may be present in the heating of the glass-ceramics plate.

Further advantages and features of the invention can also be gathered from the subclaims and the following description in connection with the drawings. These features can form advantageous embodiments of the invention both on their own and also in subcombinations with one another, and also used in other fields than those stated.

BRIEF DESCRIPTION OF THE DRAWING

The invention will now be explained with reference to the single drawing, which is a diagrammatic longitudinal section through an embodiment of the invention —i.e., a temperature switch.

DETAILED DESCRIPTION OF THE PREFERRED EMBODIMENTS

The drawing shows diagrammatically a radiant heating element 11 disposed beneath a glass-ceramics plate 12, which it heats. An insulation 42 is disposed in a supporting sheell 33. Heating resistors 13 or 14 are provided in the form of a heating coil 13, partially embedded in the insulation 42, and in the form of a high temperature radiant heating element 14, for example, a halogen lamp, whose heating coil 15 of tungsten or similar materials is contained in a quartz lamp holder 16 and which due to temperatures aboue 1500° K. has a radiation spectrum substantially in the visible zone.

Projecting through edges 17 of the insulation 42 extending as far as the glass-ceramics plate 12 is a temperature feeler 20 of a temperature switch 21 which extends transversely above the radiant heating element between the glass-ceramic plate 12 and the heating elements 13, 14.

The temperature switch 21 is a permanently adjusted, but adjustable temperature limiter whose switch mechanism indicated as a snap switch 22 switches the heating elements 13 and/or 14 off kor reduces their output in some other manner when the limitation temperature has been reached. The temperature switch 21 can also have a second switching meachanism which is adjusted to a different temperature and which, for example, can be used to indicated the hot condition of the glass-ceramics plate.

The switching mechanism 22 and if necessary the further switching mechanism is actuated by an expansion rod 24 disposed in a tube 25 made of a material which has a substantially lower coefficient of thermal expansion than that of the expansion rod 24.

The expansion rod 24 is loaded in the direction of the snap switch by a spring 26, engaging with an enlarged head 30 of the expansion rod 24, in the head 27 of the temperature switch 21 lying outside the heated zone of the radiant heating body, so that the rod 24 pulls an adjusting nut 29 disposed on a screw threading 28 at its free end against the end of the tube 25 and therefore also pulls the tube against the switch head. This so-called tie rod arrangement, in which the tie rod is the thermally active member, allows a relatively simple assembly, since the temperature sensor is retained in non-positive bearing by the spring itself, and accuracy of adjustment does not suffer, even though the attachment is rather flexible.

The expansion rod 24 is made of a chromium-iron aluminum alloy which preferably contains about 22% chromium and 5% aluminum and which is produced as a heating conductor alloy by Kanthal AB, Sweden, under the name Kanthal A or A1 or AF. After the rod made from this material has been provided with a head 30 for the engagement of the spring 26 and the screwthread 28, the rod is subjected to preageing in a normal atmosphere at a temperature above 800° C., preferably at about b 1200° C. This also cancels out the stressing caused by the mechanical reshaping, and as a result the switching amplitude is suprisingly increased by about ±3 K.

The tube 25, which has a lower thermal expansion than the material of the expansion rod 24 and is used as a comparison norm for the latter, is advantageously made of a mainly radiation-absorbing material. This means that in practice it does not let radiation through, but on the other hand also absorbs radiation to the maximum extent and does not reflect radiation. Advantageously a ceramics material, more particularly cordierite KER 410, could be used. Cordierite is a mixed crystal of the oxides of magnesium, aluminum and silicon ($2MgO \times 2Al_2O_3 \times 5SiO_2$). The ceramic KER 410 is fired from clay substance-magnesium silicate-containing bodies at temperatures arounnd 1400° C. and has the mineral cordierite as it s main component. It can also be produced via the melting phase and subsequent crystallization treatment (cf. D.M. Mueller "Sintered Cordierite Glass-Ceramic Bodies", Corning N.Y., U.S. Pat. No. 3,926,648). Cordierite is a sintered material which is mainly radiation-absorbing.

Another material suitable for the tube 25 is glass-ceramic, for example, of the type Ceran 85573. This material is a glass-ceramics having low transmission and high radiation absorption, which is achieved by an admixture of metal oxides.

Furthermore, a tube 25 of non-transparent quartz material has been sucessfully tested, for example, made of the "Rotosil" of the Heraeus Company. In this case also impermeability to radiation and absorptivity were achieved by an admixture of metal oxides.

In all cases it was possible to achieve varying thermal delay and switching amplitude delay in accordance with the particular requirements. More particularly the delay was greater, thus meeting practical requirements, when high temperature radiation heating elements 14 were used, so that on the first response with a previously cold temperature sensor, switch-off takes place later than during subsequent continuous operation. More particularly, the switching hysteresis and amplitude were also increased without any adverse effects on response sensitivity. The switching amplitude should be about of the order of magnitude of between 4° and 10° K. (preferably 5° to 7° K.) to achieve a switching frequency of less than 5 switchings per minute. Otherwise, the maximum number of switchings per minute defined per minute by individual local determinations might be exceeded, due to mains and radio interference. In this connection the radiation-absorbing construction of the tube 25 is particularly advantageous if the thermal mass is increased. This can be done by the previously customary wall thickness of such tubes, namely 1 mm, being substantially exceeded, a thickness of 3 mm being preferably selected. It would also be possible to provide other heat-storage means on the tube. It is also conceivable to provide the radiation-absorbing properties in a surface coating, while the tube has heat-storage properties. By the use of a tube material of low thermal conductivity the tube can be prevented from giving off heat to the expansion rod, something which might also be achieved by insulating measures disposed between the rod and the tube.

Preferably the radiation-absorbing material used on the tube is radiation-absorbing throughout the wave length range essential for radiation heating, more particularly in the range originating directly from the particular radiation source, so that the response behavior is mainly determined by the heating and not by secondary radiators, for example, the glass-ceramics plate. This characteristic is ensured by the materials described, but it can also be achieved using other materials.

We claim:

1. A temperature switch to be subjected to radiation heating from a radiant heating element, the temperature switch having a least on switch contact and a temperature sensor, and comprising:

an expansion rod made of a material having a relatively high coefficient of thermal expansion, and a tube which encloses the expansion rod made of a material having a relatively lower coefficient of thermal expansion;

the tube being made of a radiation-absorbing material which mainly absorbs radiation only in a wavelength range arriving directly from the radiant heating element for temporarily delaying response of the expansion rod.

2. A temperature switch according to claim 1, wherein the tube retains heat from said radiant heating element and transmits said heat to said expansion rod after said expansion rod has engaged said switch contact, thereby delaying the cooling of said expansion rod.

3. A temperature switch according to claim 1, wherein the tube has thermally isolating properties.

4. A temperature switch according to claim 1, wherein the tube is made of a sintered ceramic material.

5. A temperature switch according to claim 1, wherein the tube is made of glass-ceramic.

6. A temperature switch according to claim 1, wherein the tube is made of a radiation-absorbing, non-transmissive quartz material.

7. A temperature switch according to claim 1, wherein said radiation-absorbing material of the tube contains a metal oxide admixture.

8. A temperature switch according claim 1, wherein the expansion rod is made at least partially of a chromium-iron-aluminum alloy which is heat treated at a temperature above 800° C.

9. A temperature switch according to claim 8, wherein the heat treatment temperature is above 1100° C.

10. A temperature switch according to claim 8, wherein the chromium-iron-aluminum alloy contains about 22% percent chromium and about 5% aluminum.

11. A temperature switch according to claim 8, wherein the expansion rod is resiliently subjected to tensile loading and is connected to the tube at an end of the rod remote from the switch contact via an adjustable connection.

12. A temperature switch according to claim 8, said temperature switch being permanently adjustable to a limitation temperature, and further comprising a second signal contact for actuating a hot indication for a cooking place.

13. A temperature switch according to claim 8, wherein the radiant heating element has at least one high temperature radiation heating element and a heating resistor enclosed by a lamp holder.

14. A temperature switch according to claim 4, wherein the tube is made of cordierite.

15. A temperature switch according to claim 5, wherein the glass ceramic has thermally isolating properties.

* * * * *